US011747121B2

(12) United States Patent
Kimball et al.

(10) Patent No.: US 11,747,121 B2
(45) Date of Patent: Sep. 5, 2023

(54) DESPIN MAINTENANCE MOTOR

(71) Applicant: BAE SYSTEMS Information and Electronic Systems Integration Inc., Nashua, NH (US)

(72) Inventors: Steven F. Kimball, Auburn, NH (US); Andrew W. White, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 179 days.

(21) Appl. No.: 17/111,914

(22) Filed: Dec. 4, 2020

(65) Prior Publication Data

US 2022/0178664 A1 Jun. 9, 2022

(51) Int. Cl.
*F42B 10/26* (2006.01)
*F42B 15/01* (2006.01)

(52) U.S. Cl.
CPC ..... *F42B 10/26* (2013.01); *F42B 15/01* (2013.01)

(58) Field of Classification Search
CPC . F42B 10/26; F42B 15/01; F41G 7/22; B64C 13/00
See application file for complete search history.

(56) References Cited

U.S. PATENT DOCUMENTS 4,076,187 A * 2/1978 Metz ..... F42B 10/64 244/3.23
4,316,132 A * 2/1982 Geppert ..... B60L 50/66 318/811
4,565,340 A 1/1986 Bains
4,656,340 A 4/1987 St Louis
4,899,955 A * 2/1990 Fattal ..... G01C 19/28 74/5.6 A
5,035,376 A 7/1991 Voigt et al.
5,379,968 A 1/1995 Grosso
5,425,514 A 6/1995 Grosso
5,709,281 A * 1/1998 Sherwin ..... B62D 15/025 340/576
6,412,419 B1 7/2002 Brinkmann
7,354,017 B2 4/2008 Morris et al.
7,963,442 B2 6/2011 Jenkins et al.
8,353,481 B2 1/2013 Rosen
9,040,885 B2 5/2015 Morris et al.
9,303,964 B2 4/2016 Wurzel et al.
9,587,923 B2 3/2017 Wurzel et al.
10,203,188 B1 2/2019 Sowle et al.
10,704,874 B2 * 7/2020 Lotan ..... F41G 7/303
(Continued)

FOREIGN PATENT DOCUMENTS

EP 0675335 A2 * 10/1995
WO 2009094603 7/2009
WO 2020072153 4/2020

OTHER PUBLICATIONS

International Search Report, PCT/US21/61326, dated Aug. 25, 2022, 11 pages.

*Primary Examiner* — Philip J Bonzell
(74) *Attorney, Agent, or Firm* — KPIP Law, PLLC; Gary McFaline

(57) ABSTRACT

The system and method of spin stabilizing a guided munition where a motor provides necessary de-spinning torque. The despun PGK portion of a guided projectile is already at high rate of spin relative to the projectile body and the motor is operated to maintain that rate.

8 Claims, 4 Drawing Sheets

(56) References Cited

U.S. PATENT DOCUMENTS

| | | | | |
|---|---|---|---|---|
| 2008/0237391 | A1* | 10/2008 | Mock | F42B 10/64<br>244/3.1 |
| 2010/0213307 | A1 | 8/2010 | Hinsdale et al. | |
| 2012/0175459 | A1* | 7/2012 | Geswender | G02B 7/022<br>102/275.9 |
| 2014/0209732 | A1* | 7/2014 | Pettersson | F42B 10/26<br>244/3.23 |
| 2018/0306563 | A1* | 10/2018 | Lotan | F42B 10/26 |
| 2020/0025543 | A1* | 1/2020 | Kautzsch | F42C 15/24 |

* cited by examiner

DESPIN MAINTENANCE MOTOR

FIELD OF THE DISCLOSURE

The present disclosure relates to precision guided munitions and more particularly to utilizing a despin maintenance motor on-board a munition to stabilize intra body spin.

BACKGROUND OF THE DISCLOSURE

A precision guidance kit (PGK) equipped projectile spins for ballistic stabilization as is common for artillery rounds, particularly large caliber artillery rounds. The PGK nose section on some units "despins" in order to provide navigation and guidance functions to the projectile. After launch, as the projectile gains altitude, the projectile performs a 'down determination' function for orientation and manipulates canard actuators to utilize canards (or fins) to eliminate the spin of the PGK portion of the projectile. As the projectile rises in elevation, the atmosphere thins. At some point, the maneuver authority (torque) that the projectile's canards can produce is less than the bearing friction between the spinning projectile body and the PGK portion of the projectile. At this point, the PGK portion begins to spin due to the torque from the bearing friction. This spinning creates several negative effects, the most detrimental of which is that GPS processing of an antenna element array cannot compensate for the higher spin rate and navigation can be lost.

Wherefore it is an object of the present disclosure to overcome the above-mentioned shortcomings and drawbacks associated with the conventional precision guided projectiles.

SUMMARY OF THE DISCLOSURE

One aspect of the present disclosure is a guided munition having a stabilized portion and a spinning section, comprising: a spin stabilization system, comprising: at least a pair of permanent magnets embedded in the spinning section; at least one reflective reference marker on the spinning section; at least a pair of coils; an optical encoder configured to detect the at least one reflective reference marker; and a controller, powered by a battery or other electrical energy source, wherein the controller comprises a timer and a transistor.

One embodiment of the guided munition is wherein the spinning section and the stabilized section are coaxial with respect to each other.

Another embodiment of the guided munition is wherein a sense coil replaces the optical encoder and is connected to a high impedance input of a comparator, such that as the magnet passes the sense coil a voltage is induced in the sense coil, tripping the input of the comparator to create a signal that is sent to the controller marking a rotation of the spinning section.

Yet another embodiment of the guided munition further comprises a lookup table of pulse delay and width created to apply a specified amount of torque as commanded by a guidance section of the munition for a current spin rate of a body of the projectile. In some cases, the amount of torque is equal to the bearing friction less any residual torque created by the canards when partial atmosphere remains. In certain embodiments, the time and duration of the application of power to the coils is determined from the rotation rate of the spinning section and the desired torque.

Another aspect of the present disclosure is a guided munition, comprising: a spinning section; a stabilized section; a spin stabilization system, comprising; at least a pair of permanent magnets embedded in the spinning section; a sense coil on the stabilized section configured to have an induced voltage when passing the permanent magnets; at least one comparator coupled to the sense coil to create a pulse marking a rotation of the spinning section; at least a pair of coils; and a controller, powered by a battery or other source of electrical energy, wherein the controller comprises a timer and a transistor.

One embodiment of the guided munition is wherein the spinning and the non-spinning sections are coaxial with respect to each other. In certain embodiments, as the magnet passes the sense coil a voltage is induced in the sense coil, tripping the input of the comparator to create a signal that is sent to the controller marking the rotation of the body.

Another embodiment of the guided munition further comprises a lookup table of pulse delay and width created to apply a specified amount of torque as commanded by the guidance section for a current spin rate of a body of the projectile. In some cases, the amount of torque is equal to the bearing friction less any residual torque created by the canards when partial atmosphere remains.

In certain embodiments, the time and duration of the application of power to the coils is determined from the rotation rate of the spinning section and the desired torque.

Yet another aspect of the present disclosure is a method of spin stabilizing to a PGK portion of a guided munition, comprising: providing a spin stabilizing motor, comprising: a spinning section, comprising: at least a pair of permanent magnets embedded in the spinning section; and at least reference marker; anon-spinning section, comprising: at least a pair of coils; a sensor configured to detect the at least one reference marker; and a controller powered by a battery or other electrical energy source, wherein the controller comprises a timer and a transistor; and implementing, via the controller, the following method: incrementing a COUNTER register on each cycle of a clock input; loading, in a register T, a torque command; storing, in a rotation rate register R, a current value of the COUNTER when a signal arrives indicating a rotation of the body; and resetting a value in the COUNTER register to 0.

One embodiment of the method further comprises: combining the value in register R with the value of register T to form an address into a look up table which contains two register values, P and X; and decrementing P and X registers on each cycle of the input clock, such that decrementing stops when the register reaches 0, wherein when the P register reaches 0, power is applied to the coils and when the X register reaches 0, power is removed.

Another embodiment of the method further comprises turning on power to the coils at a time determined from a rotation rate and a desired torque; and keeping power applied for a time being determined by the same factors. In some cases, the spinning and the non-spinning sections are coaxial with respect to each other.

Yet another embodiment of the method is wherein a sense coil replaces the optical decoder and is connected to a high impedance input of a comparator, such that as the magnet passes the sense coil a voltage is induced in the sense coil, tripping the input of the comparator to create a signal that is sent to the controller marking the rotation of the body.

In certain embodiments, the lookup table is used to apply a specified amount of torque as commanded by the guidance section for a current spin rate of a body of the projectile.

Yet another embodiment of the method is wherein the values for P and X are computed as a function of R and T and when P is zero and X is not zero, power is applied to the coils. In some cases, on each clock cycle, the value of COUNTER is compared to P, such that when COUNTER and P are equal, power is applied to the coils and the power remains applied until COUNTER and X are equal, at which time power is removed from the coils.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Figure 1:
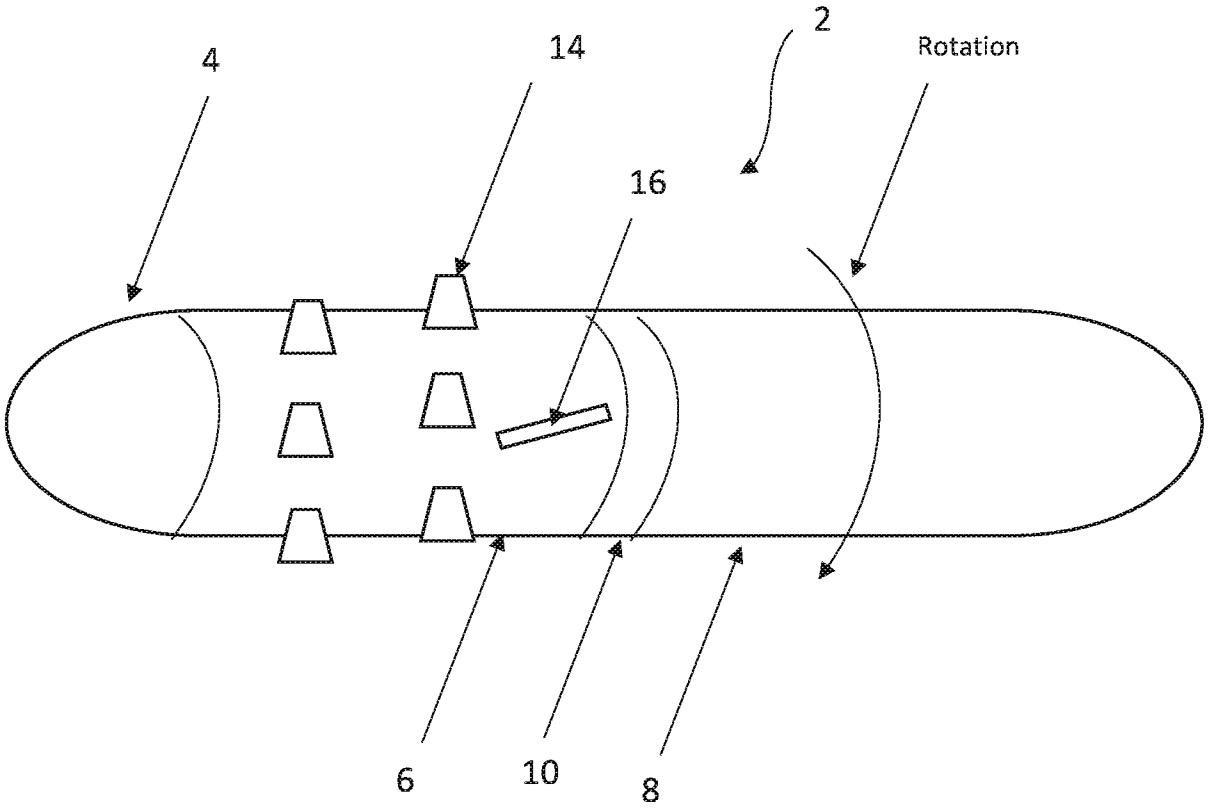
FIG. 1 is a lateral view of one embodiment of a spinning projectile having a precision guidance kit (PGK) portion according to the principles of the present disclosure.

Guided projectiles spin for ballistic stabilization. Referring to FIG. 1, a lateral view of one embodiment of a projectile having a precision guidance kit (PGK) portion according to the principles of the present disclosure is shown. More specifically, a projectile 2 has a body 8, a PGK section 6, and a nose section 4. The body 8 is a spinning section while the PGK section 6 is sometimes referred to as a non-spinning section although there is typically some spin during operation. For purposes of this description the non-spinning section is referred to as the stabilized section. The bearing 10 separates the spinning section and the non-spinning section. The PGK section 6 of the projectile 2 despins to provide for accurate navigation and guidance functions for the projectile. The nose section 4 may or may not despin depending on the design of the fuse for munition. In some cases, the nose is part of the despun PGK section. In some cases, the bearing extends through the despun PGK section so the nose and artillery body spin together.

Typically, after launch, the projectile 2 performs a down determination function and manipulates canard actuators 16 to eliminate spin of the precision guidance (PGK) portion of the projectile. There is typically high relative rotation between the projectile body 8 and the despun PGK portion 6 of the projectile. At certain operating points of spin rate and atmospheric density, the torque produced by the canards does not exceed the bearing friction between the spinning projectile body 8 and the PGK portion 6 and the PGK portion tends to spin. Simple GPS systems cannot typically compensate for high spin rates, and as such navigation can be lost. In addition, the munition may not have access to GPS if operating in a GPS denied environment.

Instead of relying solely on canards (or fins) on the projectile to despin the PGK portion, one embodiment of the present disclosure uses a motor 100 to provide necessary despinning torque. The despun PGK portion in one example is already at high rate of spin relative to the projectile body due to canard de-spinning immediately after launch. Therefore, the motor solution does not require any startup torque or even torque at low spin rates as it is already at a high spin rate and the motor only operates to maintain that rate. In one example, the maximum required motor torque is only the bearing friction. This design implements a minimal positive torque motor that uses only fixed components and minimal electronics.

The system of the present disclosure comprises all solid-state components, no mechanical moving parts other than the bearing between the PGK section 6 and the body 8. The system provides for maintenance of spin stabilization and provides a less complex solution, since no start up torque is needed for the motor, the motor only needs to maintain the spin rate. As used herein, projectile could be a round, a weapon, a ballistic, a bullet, a munition, or a guided weapon. In certain embodiments, the projectile comprises antenna elements 14 used in navigation and guidance.

The present disclosure provides a motor onboard the projectile for providing spin stabilization to the PGK portion. Typically, motors are not used onboard because they require significant power to drive a motor, the motor adds considerable weight, occupy space, and may not survive launch. Here, the motor in one example is a rotational brushless DC motor such as a permanent magnet motor that is powered by the rotation or spin. In one example the de-spin implementation provides de-spinning torque that can augment the on-board de-spinning capability. Certain embodiments of the present disclosure could be used to provide de-spin stabilization for exo-atmospheric or near exo-atmospheric projectiles that depend on canards to despin a section of the projectile body.

In the high altitude, long range case angular momentum must be added to the system as bearing friction is bleeding off angular momentum as heat in the bearing and there is not enough atmospheric density for the canards to transform velocity to angular momentum via a torque. Without a battery to create the correct magnetic fields at the correct times, the magnet will increase the drag in the bearing, making the problem worse, not better. Most prior systems assume a low altitude trajectory where there is an abundance of airflow/density with which to produce torque and the flight time is short so bleeding off the spin rate to produce torque is perfectly acceptable.

Figure 2:
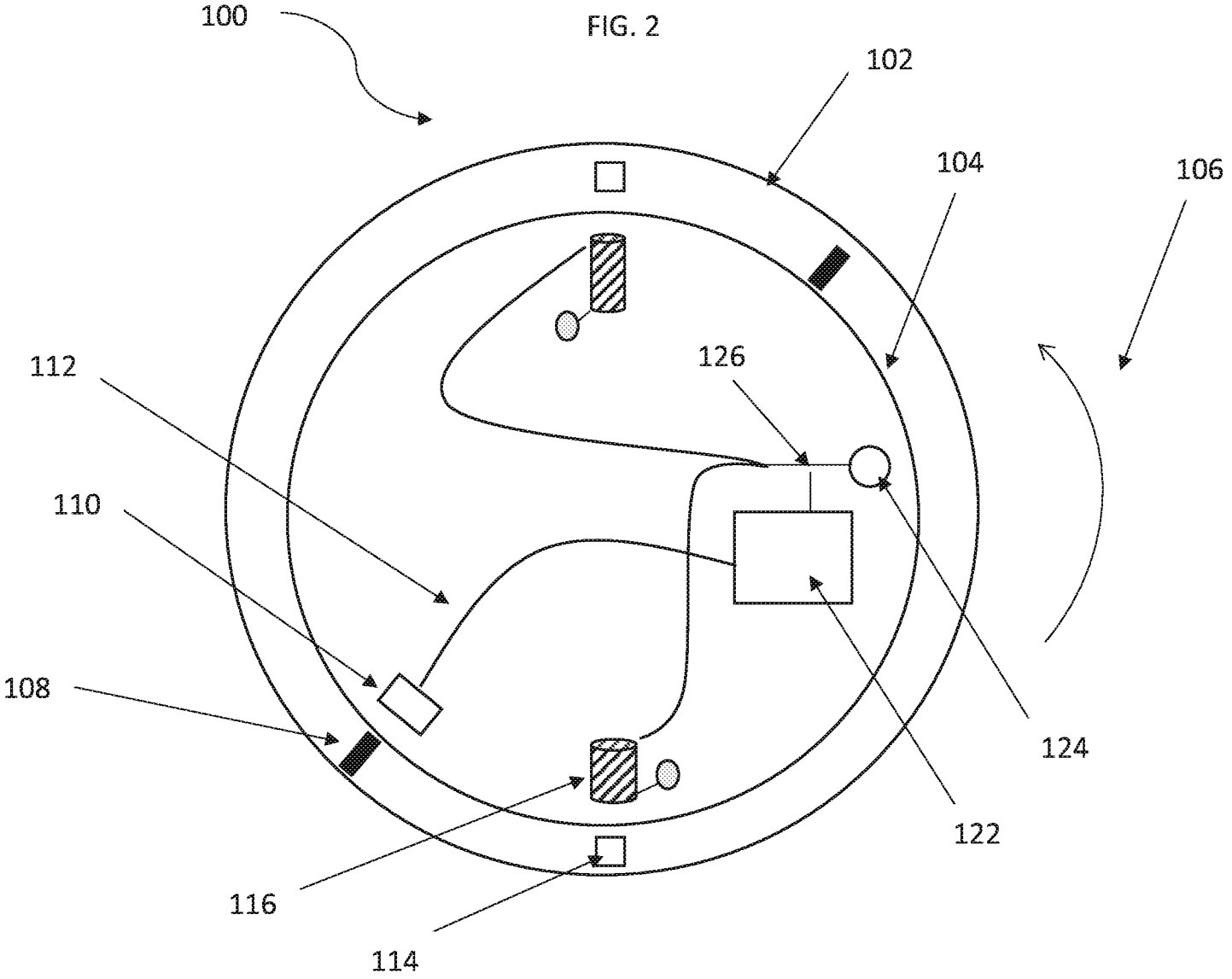
FIG. 2 is an end view of a bearing between one embodiment of the spinning projectile body and a stabilized precision guidance kit (PGK) portion according to the principles of the present disclosure.

Referring to FIG. 2, an end view of the bearing between one embodiment of the spinning projectile body and a stabilized precision guidance kit (PGK) portion according to the principles of the present disclosure is shown. More specifically, one embodiment of the despin maintenance motor 100 of the present disclosure has an outer portion 102 and an inner portion 104, where the outer and inner portions form spinning and non-spinning portions, respectively. Permanent magnets 114 (two shown in this figure) are always present in the spinning section 102, and there are no mechanical or electrical connections between the spinning and the stabilized (non-spinning) portion 104 other than the bearing. In certain embodiments, the magnets 114 are small such as 2 mm×2 mm×2 mm. In certain embodiments, the spinning portion further comprises one or more reflective markers 108 at some offset from the permanent magnets 114. While the system will not reverse, the design can support either clockwise (CW) or counterclockwise (CCW) rotation 106.

Still referring to FIG. 2, in this embodiment, the inside stabilized portion 104 is the despun PGK portion. It comprises two or more coils 116, a controller 122, which contains control circuitry described herein, some form of transistor such as a field effect transistor (FET) 126, and an electrical power source 124. The FET is a type of transistor which uses an electric field to control the flow of current. FETs are devices with three terminals: source, gate, and drain. FETs control the flow of current by the application of a voltage to the gate, which in turn alters the conductivity between the drain and source. In certain embodiments, the despun inner portion further comprises an optical encoder 110 (e.g., an LED and a photodetector) to read the spinning body's reference marks. The passing of a reference mark on the spinning portion is signaled to the controller 122 via a signal line 112. The controller comprises a timer circuit that starts a pulse of energy to the coils 116 via the FET 126 at a programmable delay after the encoder detects the passing of the reference mark and keeps the pulse on for a programmable duration. The delay and the duration are set by the guidance system control loop to vary the amount of torque applied to the PGK portion in order to keep it from starting to spin with respect to "down." When the controller 122 is off, and the FET 126 is off, the magnets 114 and coils 116 consume essentially no power and add minimal drag to the bearing assembly.

An added benefit to the system of the present disclosure is that it can provide spin control throughout the flight and reduce the amount of drag from the control canards as they no longer need to deflect to maintain spin stabilization. In certain embodiments, the system will require the specific parameters of the range of projectile spin rates and the bearing friction at those spin rates as inputs. This will allow the determination of the size and number of magnet chips to embed in the spinning body section and the size and composition (number of windings, wire material, and wire diameter) of the coils (nominally 3 mm diameter) and the size and power dissipation required for the FET. In some cases, a lookup table of pulse delay and width will be created to apply a specified amount of torque as commanded by the guidance section for the current spin rate of the projectile body. Since this is solely to maintain spin against friction, the torque will range from 0 to max friction. There is no requirement to reverse the motor. In some cases, the system can also be used to augment the canards to reduce drag if there is sufficient electrical energy available.

FIG. 2 references a reflective reference mark 108 and an optical encoder 110 to detect the rotation of the projectile body. An alternative method would be to use a sense coil and a comparator. The sense coil would replace and be aligned in a manner similar to the photodetector 110 and it could be connected to the high impedance input of a comparator. As the magnet 108 passes the coil at 110, a voltage is induced in the coil, tripping the input of the comparator to create a signal that is sent to the controller 122 via 112, marking the rotation of the body.

In certain embodiments, the controller 122 has two inputs, a clock signal which occurs at regular intervals Tc, and a torque command. The torque command can either be an analog voltage or a digital register. One embodiment of a digital register implementation is further described, as methods for converting an analog voltage to a digital register value are well known and could readily be incorporated into the CTRL element 122. In certain embodiments, the CTRL element 122 implements the following method, and it can be implemented as either software in a PIC (Peripheral Interface Controller) device or similar micro-processor, or it can be implemented in a PLD (Programmable Logic Device) as a logical state machine directly.

Figure 4:
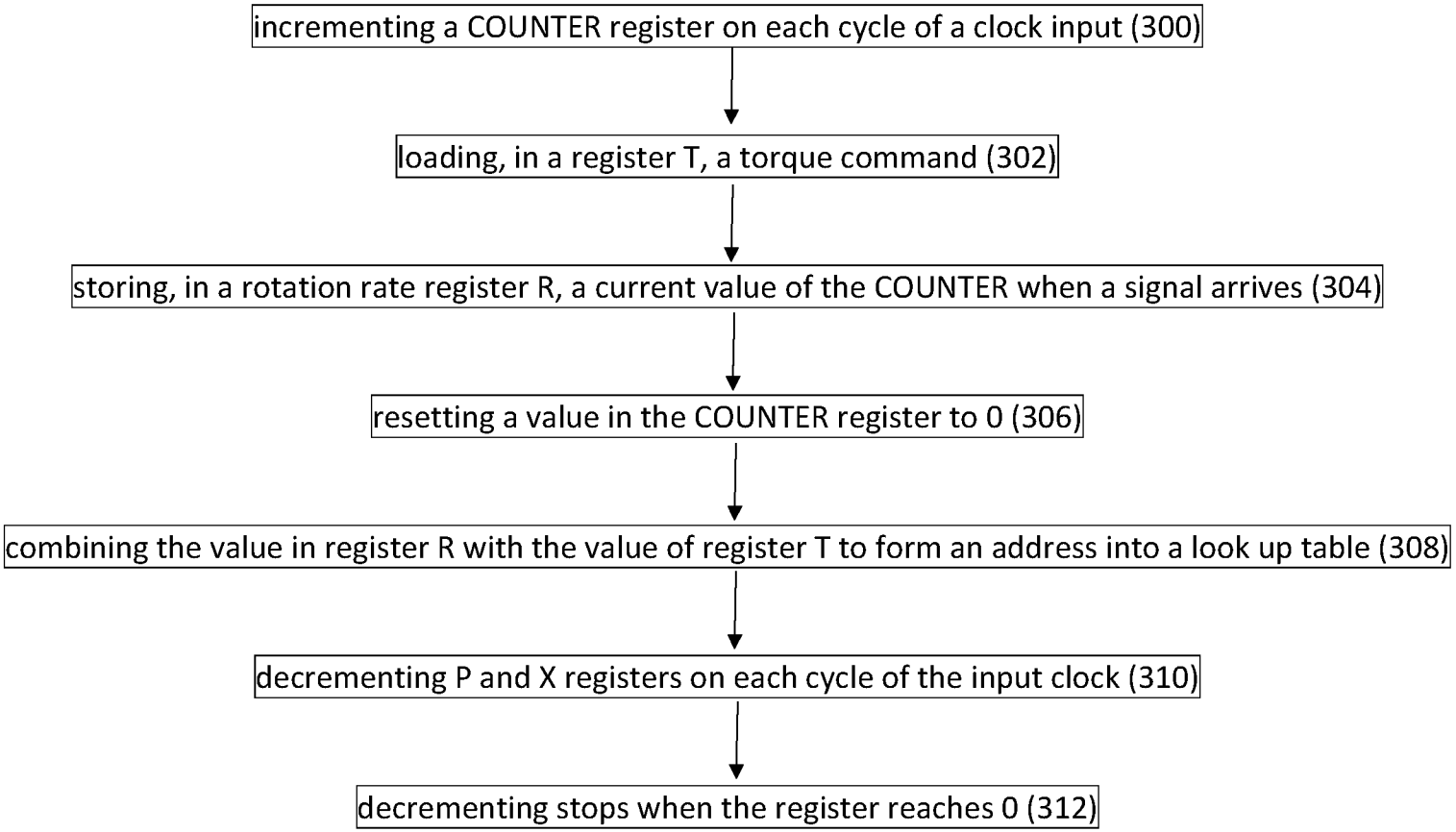
FIG. 4 is a flowchart of one embodiment of a method for providing spin stabilization for a projectile according to the principles of the present disclosure.

Referring to FIG. 4, a flowchart of one embodiment of a method for providing spin stabilization for a projectile according to the principles of the present disclosure is shown. More specifically, first, there is a COUNTER register which is incremented on each cycle of the clock input 300, second, a torque command is loaded into the register T 302. Third, when the encoder (either optical or sense coil) signal arrives, the current value of COUNTER is stored in the rotation rate register R 304 and the value in COUNTER is reset to 0 306. The new value in R is combined with the value of register T to form an address into a LUT (Look Up Table) which contains two register values, P and X 308. The P and X registers are decremented on each cycle of the input clock 310. Decrementing stops when the register reaches 0 312. When the P register reaches 0, power is applied to the coils. When the X register reaches 0, power is removed. Coil power is ~P & X, meaning 'when P is zero and X is not zero', power is applied to the coils.

In one alternative, the values for P and X can be computed as a function of R and T. (e.g., P=3*R/4−T, X=3*R/4−T/2). In another alternative embodiment, on each clock cycle, the value of COUNTER is compared to P. When COUNTER and P are equal, power is applied to the coils. The power remains applied until COUNTER and X are equal, at which time power is removed from the coils.

It is to be understood that there are many alternate designs that accomplish the same function of turning on power to the coils at a time determined from the rotation rate and desired torque and keeping power applied for a time determined by the same factors. These alternatives are within the scope of the present disclosure.

Figure 3:
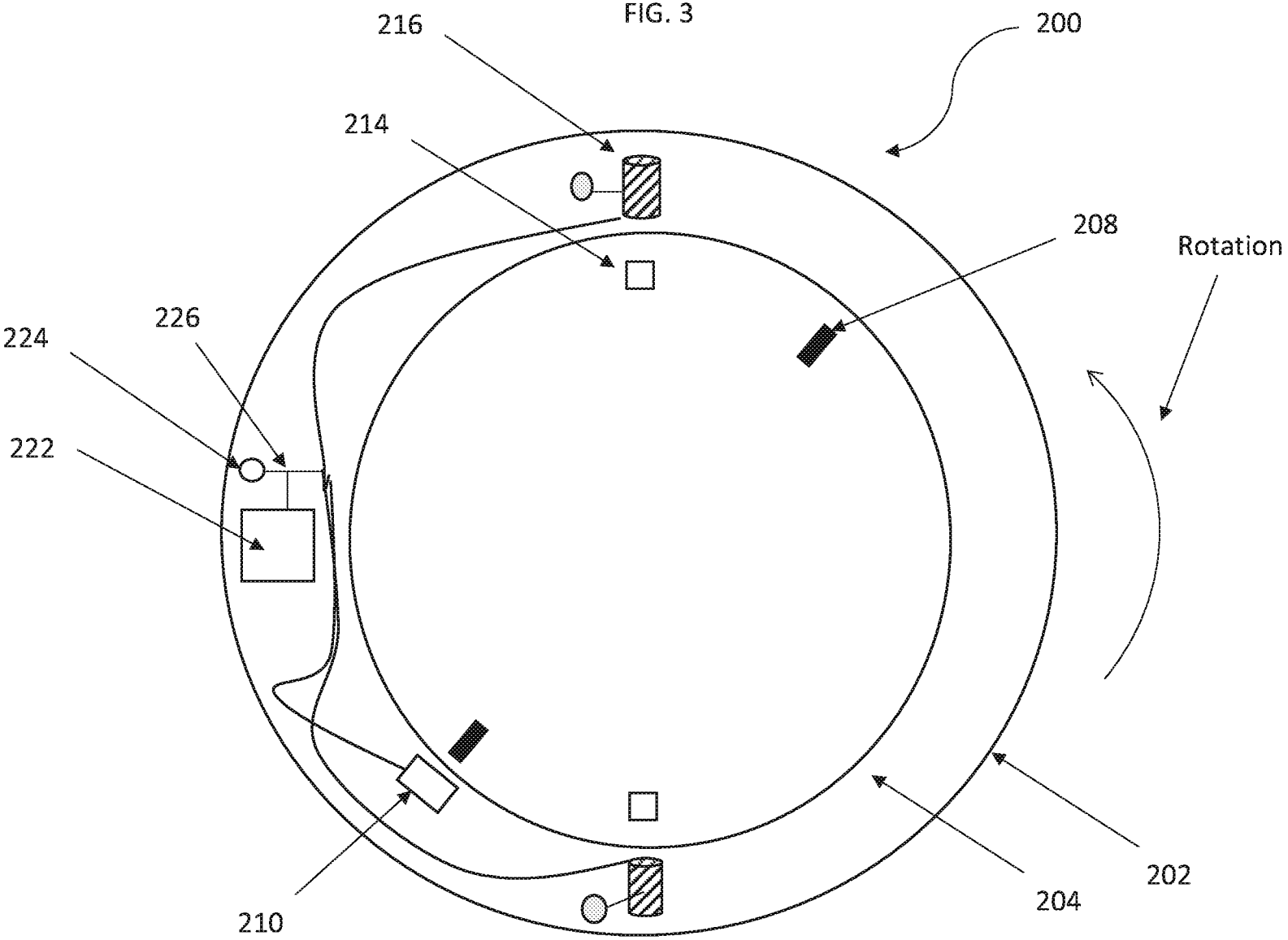
FIG. 3 is an end view of a bearing between another embodiment of the spinning projectile body and a stabilized precision guidance kit (PGK) portion according to the principles of the present disclosure.

Referring to FIG. 3, an end view of a bearing between another embodiment of the spinning projectile body and a stabilized precision guidance kit (PGK) portion according to the principles of the present disclosure is shown. More specifically, the rotational body 204 (with magnets 214) could be inside and the coils 216 could be on de-spun outside portion 202. The principle of operation is identical to FIG. 2, only FIG. 3 is an inner bearing embodiment between the spinning and de-spun sections versus an outer bearing embodiment in FIG. 2. The magnets and marks are always both on the spinning section. The coils, sensors, and processor are on the stabilized section regardless of whether the de-spun section in inside a spinning shell or surrounding a spinning core.

Again, once the down determination has been made, the control canards are not the only possible source of torque between the projectile body and the PGK section. In fact, any source of torque can be used to de-spin the PGK section. The canards being the most expedient since they must already exist to provide guidance forces for the projectile to steer to its target. However, in one embodiment of the system of the present disclosure a motor is used to provide the necessary de-spinning torque. A critical observation is that the 'despun' PGK section is already at a high rate of spin relative to the projectile body so the motor solution does not require any startup torque or even torque at very low spin rates. The system of the present disclosure is at a high spin rate and only operates to maintain that rate. The maximum required motor torque is only the bearing friction. Both FIG. 2 and FIG. 3 illustrates embodiments of a motor that is integrated into a PGK assembly to provide the "maintenance torque" required to keep the PGK section from spinning when the atmosphere is too thin for the control canards to overcome the bearing friction or any other condition where additional de-spin maintenance torque is desired.

In this embodiment, the motor 200 consists of two tiny permanent magnets 214 on the order of 2 mm×2 mm×2 mm that are embedded in the spinning section 204 of the PGK section. In this embodiment the de-spun section is outside and surrounding the spinning section. There are also two reflective reference marks 208 at the proper offset from the magnets 214 mounted on the spinning section. Inside the powered despun PGK section are two tiny coils 216, a FET 226, a controller 222, a power source 224, and an optical encoder 210 (an LED and a photodetector) that reads the body reference mark 208 as it passes by on the spinning portion. The controller 222 consists of a simple timer circuit that starts a pulse at a programmable delay after the encoder detects the passing of the reference mark and keeps the pulse on for a programmable duration. The delay and pulse duration are set by the guidance system control loop to vary the amount of torque applied to the PGK section in order to keep it from starting to spin with respect to "down." When the controller 222 is off, and the FET 226 is off, the presence of the magnets 214 and open-loop coils 216 consume essentially no power and add minimal drag to the bearing assembly. Some drag is inevitable as the moving magnets will generate eddy currents in any passing conductive material.

The computer readable medium as described herein can be a data storage device, or unit such as a magnetic disk, magneto-optical disk, an optical disk, or a flash drive. Further, it will be appreciated that the term "memory" herein is intended to include various types of suitable data storage media, whether permanent or temporary, such as transitory electronic memories, non-transitory computer-readable medium and/or computer-writable medium.

It will be appreciated from the above that the invention may be implemented as computer software, which may be supplied on a storage medium or via a transmission medium such as a local-area network or a wide-area network, such as the Internet. It is to be further understood that, because some of the constituent system components and method steps depicted in the accompanying FIG.s can be implemented in software, the actual connections between the systems components (or the process steps) may differ depending upon the manner in which the present invention is programmed. Given the teachings of the present invention provided herein, one of ordinary skill in the related art will be able to contemplate these and similar implementations or configurations of the present invention.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to, and executed by, a machine comprising any suitable architecture.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A guided munition comprising:

a body section;

a precision guidance kit ("PGK") section coaxial to the body section;

a despin maintenance motor disposed between and coaxial to the body section and the PGK section;

wherein the despin maintenance motor comprises:

a spinable outer section having a plurality of magnets and a plurality of markers;

an inner section stationary relative to the spinable outer section and having a plurality of coils and an optical encoder;

a power source;

a timer circuit;

a field effect transistor ("FET"); and a controller in electrical communication with the plurality of coils, the power source, the FET, and the optical encoder;

wherein the controller is configured to receive a signal from the optical encoder when a marker on the spinable outer section crosses a field of view of the optical encoder, the controller being further configured to transmit electricity via the FET to coils in the inner section in response to the marker crossing the field of view of the optical encoder, wherein the transmission of electricity via the FET to the coils generates torque between the spinable outer section and the inner section.

2. The guided munition according to claim 1, wherein the controller is further configured to transmit electricity as a pulse via the FET to the coils and wherein the controller further comprises a lookup table, said lookup table comprising pulse delays and widths necessary to generate a desired amount of torque for a given spin rate of the spinable section.

3. The guided munition according to claim 2 further comprising a plurality bearings disposed between the spinable outer section and the inner section and wherein the desired amount of torque is equal to the friction generated by the bearings less any residual torque created by the munition.

4. The guided munition according to claim 1, wherein the time and duration of the transmission of electricity, via the FET, from the controller to the coils is determined from the rotation rate of the spinable outer section and a desired torque.

5. A guided munition, comprising:

a body section;

a precision guidance kit ("PGK") section coaxial to the body section;

a despin maintenance motor disposed between and coaxial to the body section and the PGK section;

wherein the despin maintenance motor comprises:

a spinable outer section having a plurality of magnets and a plurality of markers;

an inner section stationary relative to the spinable outer section and having a plurality of coils and a sense coil;

a power source;

a timer circuit;

a field effect transistor ("FET"); and a controller in electrical communication with the plurality of coils, the power source, the FET, and the sense coil;

wherein the controller is configured to receive a signal from the sense coil when a magnet on the spinable outer section crosses the sense coil, the controller being further configured to transmit electricity via the FET to coils in the inner section in response to the magnet crossing the sense coil, wherein the transmission of electricity via the FET to the coils generates torque between the spinable outer section and the inner section.

6. The guided munition according to claim 5, wherein the controller is further configured to transmit electricity as a pulse via the FET to the coils and wherein the controller further comprises a lookup table, said lookup table comprising pulse delays and widths necessary to generate a desired amount of torque for a given spin rate of the spinable section.

7. The guided munition according to claim 6 further comprising a plurality bearings disposed between the spinable outer section and the inner section and wherein the desired amount of torque is equal to the friction generated by the bearings less any residual torque created by the munition.

8. The guided munition according to claim 5, wherein the time and duration of the transmission of electricity, via the FET, from the controller to the coils is determined from the rotation rate of the spinable outer section and a desired torque.

* * * * *